US009472334B2

(12) United States Patent
Syvaranta et al.

(10) Patent No.: US 9,472,334 B2
(45) Date of Patent: Oct. 18, 2016

(54) TRANSFORMER

(71) Applicant: Efore Oyj, Espoo (FI)

(72) Inventors: Lauri Syvaranta, Helsinki (FI); Ilkka Heiskanen, Pornainen (FI); Vlad Grigore, Espoo (FI)

(73) Assignee: EFORE OYJ, Espoo (FI)

( * ) Notice: Subject to any disclaimer, the term of this patent is extended or adjusted under 35 U.S.C. 154(b) by 0 days.

(21) Appl. No.: 14/742,846

(22) Filed: Jun. 18, 2015

(65) Prior Publication Data

US 2015/0371765 A1 Dec. 24, 2015

(30) Foreign Application Priority Data

Jun. 19, 2014 (FI) ..... 20145590

(51) Int. Cl.
*H01F 27/29* (2006.01)
*H01F 27/28* (2006.01)
(Continued)

(52) U.S. Cl.
CPC ..... *H01F 27/2852* (2013.01); *H01F 27/24* (2013.01); *H01F 27/303* (2013.01); *H01F 27/306* (2013.01); *H01F 27/34* (2013.01); *H01F 2027/2857* (2013.01)

(58) Field of Classification Search
CPC .. H01F 27/2852; H01F 27/24; H01F 27/303; H01F 27/306; H01F 27/34; H01F 27/29; H01F 27/2847; H01F 27/2866; H01F 2027/2857; H01F 3/14
USPC ..... 336/182, 192, 170, 178
See application file for complete search history.

(56) References Cited

U.S. PATENT DOCUMENTS 3,448,340 A * 6/1969 Lewis ..... H01F 27/402 336/147
3,891,955 A 6/1975 Horton, III
(Continued)

FOREIGN PATENT DOCUMENTS

JP H10335156 12/1998
JP H114581 2/1999
(Continued)

OTHER PUBLICATIONS

European search report, dated Oct. 5, 2015; Application No. 15 17 1379.
(Continued)

*Primary Examiner* — Mangtin Lian
(74) *Attorney, Agent, or Firm* — Young & Thompson

(57) ABSTRACT

A transformer comprises first winding portions (101, 102) constituting a first foil winding and second winding portions (103, 104) constituting a second foil winding having a substantially same magnetic axis as the first foil winding. The first and second winding portions are interleaved in directions substantially perpendicular to the magnetic axis so as to reduce the leakage inductances of the first and second foil windings. The first winding portions are electrically interconnected so that at least one end-portion of each first winding portion is split to constitute two strips (105*a*, 105*b*) folded to mutually opposite directions substantially parallel with the magnetic axis, and ends of the strips of different first winding portions are interconnected to constitute connection bridges over a particular one of the second winding portions located between these first winding portions. The second winding portions are electrically interconnected in the corresponding way to constitute the second foil winding.

16 Claims, 5 Drawing Sheets

(51) Int. Cl.

| | |
|---|---|
| ***H01F 17/06*** | (2006.01) |
| ***H01F 27/24*** | (2006.01) |
| ***H01F 27/30*** | (2006.01) |
| ***H01F 27/34*** | (2006.01) |

(56) References Cited

U.S. PATENT DOCUMENTS

| | | | | |
|---|---|---|---|---|
| 3,911,332 | A | 10/1975 | Kunkel | |
| 3,939,449 | A * | 2/1976 | Boyd | H01F 27/322 336/183 |
| 4,300,112 | A * | 11/1981 | Leibinger | H01F 27/2823 336/180 |
| 4,327,311 | A | 4/1982 | Wroblewski | |
| 4,403,205 | A * | 9/1983 | Leibinger | H01F 27/2823 336/180 |
| 6,642,830 | B1 * | 11/2003 | Ball | H01F 27/29 336/192 |
| 7,701,317 | B2 | 4/2010 | Sullivan et al. | |
| 8,183,966 | B2 * | 5/2012 | Xu | H01F 27/2847 336/170 |
| 2004/0004529 | A1 | 1/2004 | Ball | |
| 2008/0169893 | A1 * | 7/2008 | Sullivan | H01F 27/2847 335/297 |
| 2014/0347156 | A1 | 11/2014 | Ono | |

FOREIGN PATENT DOCUMENTS

| | | |
|---|---|---|
| WO | 2005-096330 | 10/2005 |
| WO | 2013-084609 | 6/2013 |

OTHER PUBLICATIONS

Finland Search Report, dated Feb. 18, 2015, from corresponding Finnish application.

* cited by examiner

TRANSFORMER

FIELD OF THE INVENTION

The invention relates generally to transformers. More particularly, the invention relates to a transformer having foil windings which have interleaved portions so as to reduce the leakage inductances of the foil windings.

BACKGROUND

In many applications, there is a desire to minimize leakage inductances of windings of a transformer. For example, in a switched mode power supply "SMPS" haying the flyback topology, the leakage inductance of the primary winding causes that all the energy charged to the transformer of the flyback power supply via the primary winding cannot be discharged from the transformer via the secondary winding. A known way to reduce the leakage inductances of windings of a transformer is to use interleaved windings where each winding comprises winding portions which are interleaved with corresponding winding portions of one or more other windings of the transformer. An inherent challenge related to interleaved windings is the need to arrange electrical connections between winding portions so as to connect the winding portions to constitute a winding. An electrical connection between two winding portions belonging to a same winding have to form a connection bridge over one or more other winding portions of one or more other windings where the one or more other winding portions are located, in the interleaving arrangement, between the two winding portions of the winding under consideration. The inductance of the above-mentioned electrical connection between the winding portions should be as small as possible in order to avoid weakening or even losing the advantage provided by the interleaved windings, i.e. the reduction of the leakage inductances.

Foil windings are usual in transformers of many varieties and applications because of various advantages of the foil windings. For example, the skin effect does not reduce the effective electrically conductive area so strongly in a flat and thin foil conductor as e.g. in a round wire conductor having a same cross-sectional area. The above-presented challenge related to interleaved windings is present also in a case where foil windings of a transformer are configured to constitute interleaved windings, i.e. there is the need to arrange electrical connections between winding portions of each foil winding so that the inductances of the electrical connections are as small as possible.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying and non-limiting embodiments of the invention.

In accordance with the invention, there is provided a new transformer that can be, for example but not necessarily, a transformer of a switched mode power supply "SMPS". A transformer according to the invention comprises:

two or more first foil conductors constituting first winding portions of a first foil winding, and one or more second foil conductors constituting one or more second winding portions of a second foil winding having a substantially same magnetic axis as the first foil winding, the magnetic axis being substantially parallel with a lateral direction of the first and second foil conductors.

The first winding portions are interleaved with the second winding portions in directions substantially perpendicular to the magnetic axis so as to reduce the leakage inductances of the first and second foil windings.

The first winding portions are electrically interconnected so that:

at least one end-portion of each of the first foil conductors is split to constitute two strips folded to mutually opposite directions substantially parallel with the magnetic axis, and ends of the strips belonging to one of the first winding portions are connected to ends of the strips belonging to another one of the first winding portions so as to constitute connection bridges over a particular one of the second winding portions located between these ones of the first winding portions.

In a transformer according to an exemplifying and non-limiting embodiment of the invention, the number of the second winding portions is at least two and the second winding portions are electrically interconnected so that:

at least one end-portion of each of the second foil conductors is split to constitute two strips folded to mutually opposite directions substantially parallel with the magnetic axis, and ends of the strips belonging to one of the second winding portions are connected to ends of the strips belonging to another one of the second winding portions so as to constitute connection bridges over a particular one of the first winding portions located between these ones of the second winding portions.

As the foil conductors of the above-mentioned winding portions are used for providing electrical connections between the winding portions in the above-described way, there is no need to connect additional conductors to the end-portions of the foil conductors. Furthermore, each electrical connection between two winding portions comprises two connection bridges because the interconnected end-portions of the foil conductors are each split to constitute two strips folded to mutually opposite directions. This reduces the inductances of the above-mentioned electrical connections because the two connection bridges are substantially parallel connected. Furthermore, the electrical connections can be configured to further symmetry in the distributions of currents flowing in the foil conductors because the electrical connections can be made symmetric with respect to longitudinal symmetry lines of the foil conductors.

A transformer according to an exemplifying and non-limiting embodiment of the invention further comprises at least one third foil winding having a substantially same magnetic axis as the first and second foil windings. The third foil winding may comprise two or more third winding portions which are interleaved with the first and second winding portions and which are electrically interconnected in the way described above.

A number of exemplifying and non-limiting embodiments of the invention are described in accompanied dependent claims.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of also un-recited features. The features recited in the accompanied dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF THE FIGURES

Exemplifying and non-limiting embodiments of the invention and their advantages are explained in greater detail below with reference to the accompanying drawings, in which.

DESCRIPTION OF EXEMPLIFYING EMBODIMENTS

Figure 1A:
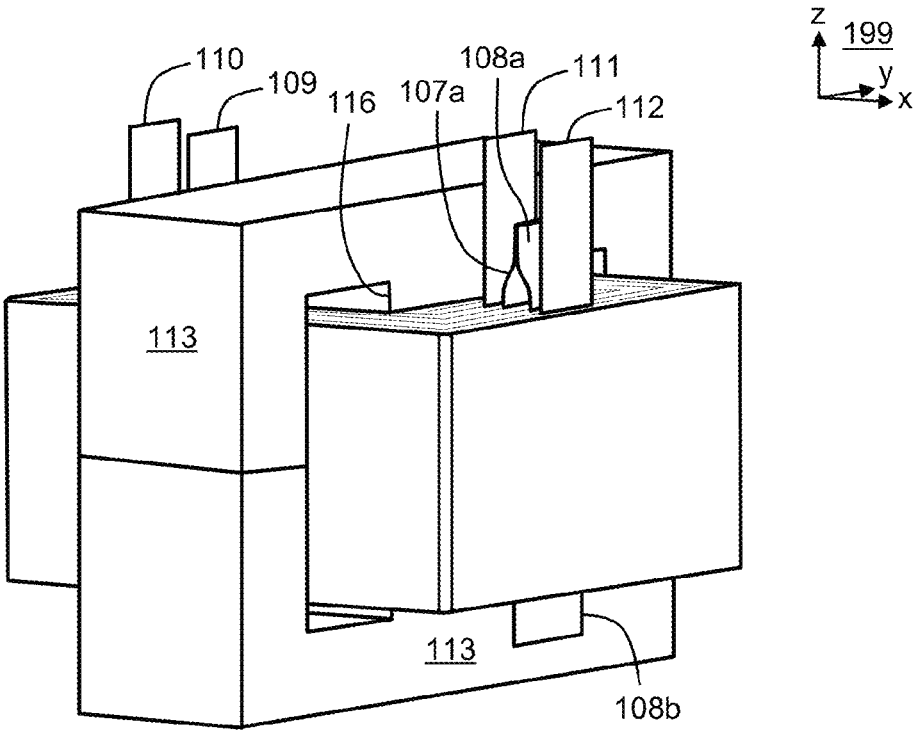
FIGS. 1*a*, 1*b*, 1*c*, 1*d* and 1*e* illustrate a transformer according to an exemplifying and non-limiting embodiment of the invention.
Figure 1B:
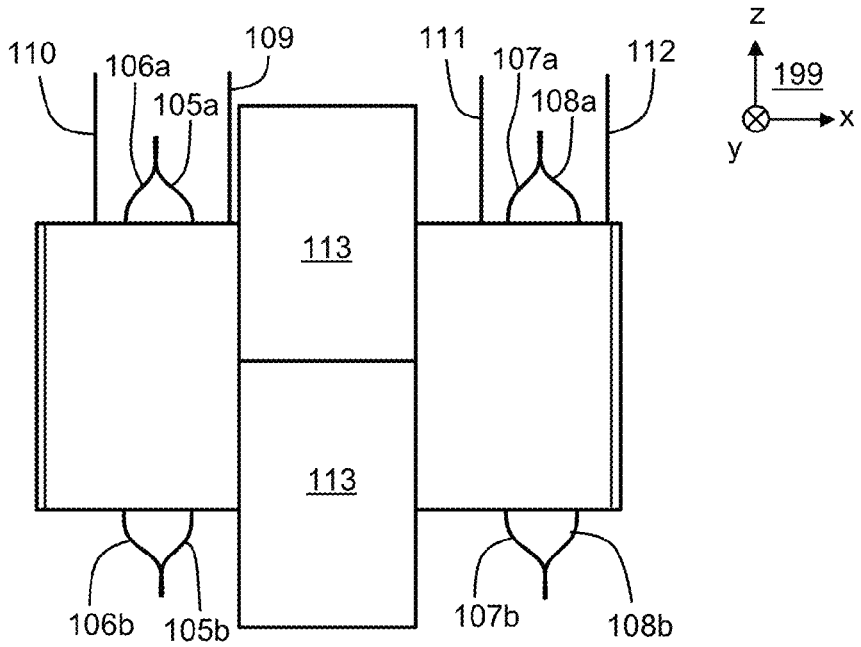
Figure 1C:
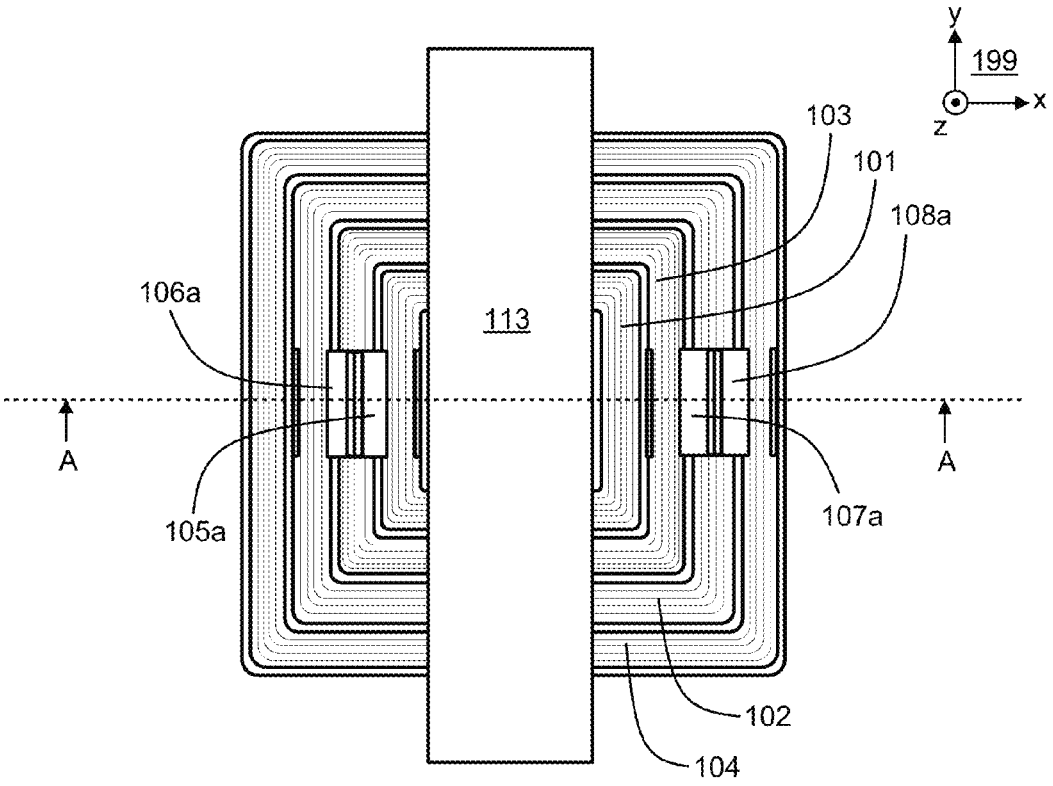
Figure 1D:
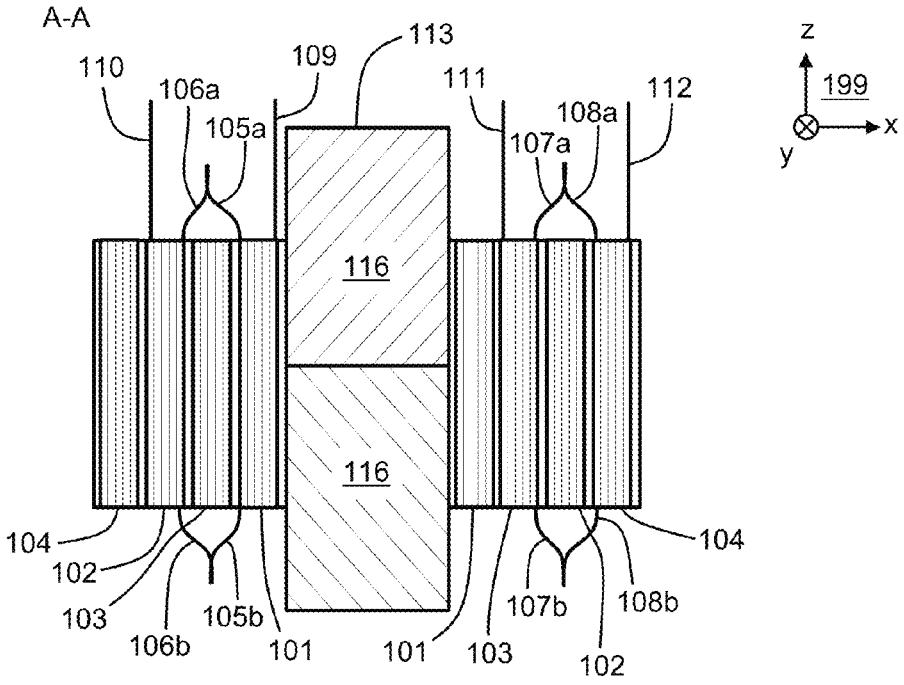

FIG. 1*a* shows a perspective view of a transformer according to an exemplifying and non-limiting embodiment of the invention. FIG. 1*b* shows a side-view of the transformer, FIG. 1*c* shows a top-view of the transformer, and FIG. 1*d* shows a view of a section taken along a line A-A shown in FIG. 1*c*. The section plane is parallel with the xz-plane of a coordinate system 199. The transformer comprises a first foil winding which can be connected to an external electrical system via connection terminals 109 and 110, and a second foil winding which can be connected to the external electrical system via connection terminals 111 and 112. The magnetic axis of the first foil winding is substantially the same as the magnetic axis of the second foil winding and parallel with the z-axis of the coordinate system 199. The transformer can be, for example but not necessarily, a transformer of a switched mode power supply "SMPS" e.g. a flyback power supply or a resonance converter. The first foil winding may operate as a primary winding and the second foil winding may operate as secondary winding.

The first foil winding of the transformer is comprised of first winding portions made of first foil conductors so that the lateral direction of the first foil conductors is parallel with the magnetic axis of the first and second foil windings, i.e. parallel with the z-axis of the coordinate system 199. The first winding portions are illustrated in FIGS. 1*c* and 1*d* and they are denoted with reference numbers 101 and 102. Correspondingly, the second foil winding of the transformer is comprised of second winding portions made of second foil conductors so that the lateral direction of the second foil conductors is parallel with the magnetic axis of the first and second foil windings, i.e. parallel with the z-axis of the coordinate system 199. The second winding portions are illustrated in FIGS. 1*c* and 1*d* and they are denoted with reference numbers 103 and 104. As illustrated in FIGS. 1*c* and 1*d*, the winding portions 101-104 are interleaved in the directions perpendicular to the z-axis of the coordinate system 199 so that the winding portion 101 is the innermost one, the winding portion 103 is between the winding portions 101 and 102, the winding portion 104 is the outermost one, and the winding portion 102 is between the winding portions 103 and 104. It is worth noting that the above-presented interleaving arrangement is only an example and many different interleaving arrangements are possible. For example, one of the foil windings, e.g. the second foil winding, can be comprised of only one winding portion which alone constitutes the foil winding under consideration and is located between the winding portions of the other foil winding. For another example, at least one of the foil windings may comprise more than two winding portions interleaved with the winding portions of the other foil winding.

Figure 1E:
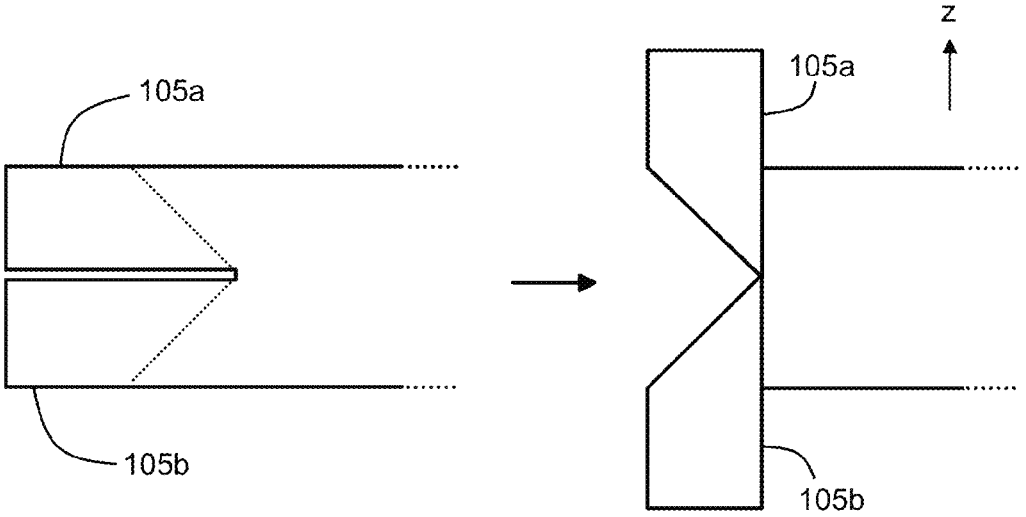

An end-portion of the foil conductor of the winding portion 101 is split to constitute two strips 105*a* and 105*b* which have been folded to mutually opposite directions substantially parallel with the z-axis of the coordinate system 199. This is illustrated in FIG. 1*e* where lines along which the strips 105*a* and 105*b* are folded are depicted with dashed lines. Correspondingly, an end-portion of the foil conductor of the winding portion 102 is split to constitute two strips 106*a* and 106*b* which have been folded to mutually opposite directions substantially parallel with the z-axis, an end-portion of the foil conductor of the winding portion 103 is split to constitute two strips 107*a* and 107*b* which have been folded to mutually opposite directions substantially parallel with the z-axis, and an end-portion of the foil conductor of the winding portion 104 is split to constitute two strips 108*a* and 108*b* which have been folded to mutually opposite directions substantially parallel with the z-axis.

The ends of the strips 105*a* and 106*a* are interconnected to constitute a connection bridge over the winding portion 103 as illustrated in FIG. 1*d*. The ends of the strips 105*a* and 106*a* can be interconnected for example by soldering or using mechanical fastening means, e.g. a bolt and a nut. Correspondingly, the ends of the strips 105*b* and 106*b* are interconnected to constitute another connection bridge over the winding portion 103. The ends of the strips 107*a* and 108*a* are interconnected to constitute a connection bridge over the winding portion 102 as illustrated in FIG. 1*d*. Correspondingly, the ends of the strips 107*b* and 108*b* are interconnected to constitute another connection bridge over the winding portion 102. As illustrated in FIG. 1*d*, the winding portions 101 and 102 are electrically interconnected with the two connection bridges constituted by the ends of the strips 105*a* and 106*a* and by the ends of the strips 105*b* and 106*b*. This reduces the inductance of the electrical connection between the winding portions 101 and 102 because the above-mentioned two connection bridges are substantially parallel connected. Furthermore, the two-sided electrical connection formed by the two connection bridges furthers symmetry in the distribution of current flowing in the foil conductors of the winding portions 101 and 102. The above-mentioned is valid also for the winding portions 103 and 104.

The exemplifying transformer illustrated in FIGS. 1*a*-1*e* comprises a core structure 113 having a leg surrounded by the first and second foil windings, where the longitudinal direction of the leg is substantially parallel with the magnetic axis of the first and second foil windings, i.e. parallel with the z-axis of the coordinate system 199. The leg is denoted with a reference number 116 in FIGS. 1*a* and 1*d*. FIG. 1*a* shows a part of the leg 116 and FIG. 1*d* shows a section view of the leg. In many applications, it is advantageous that the core structure 113 comprises ferromagnetic material. The core structure may comprise for example ferrite or a stack of ferromagnetic steel sheets. Interleaved foil windings of the kind described above are, however, also applicable in transformers which do not comprise a ferromagnetic core structure.

Figure 2A:
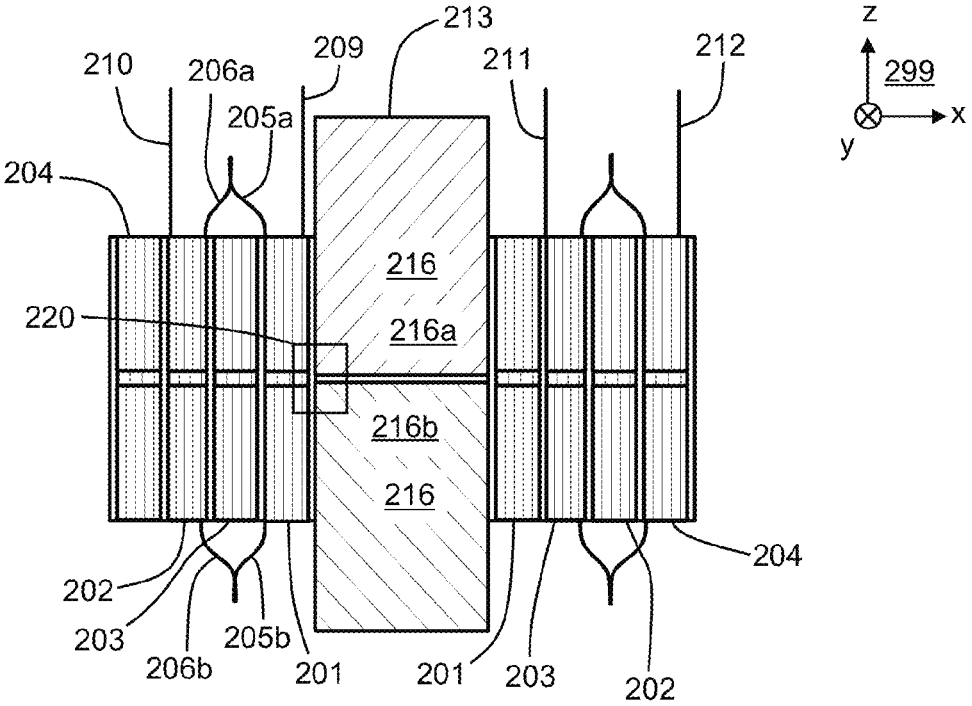
FIGS. 2*a*, 2*b* and 2*c* illustrate a transformer according to an exemplifying and non-limiting embodiment of the invention.
Figure 2B:
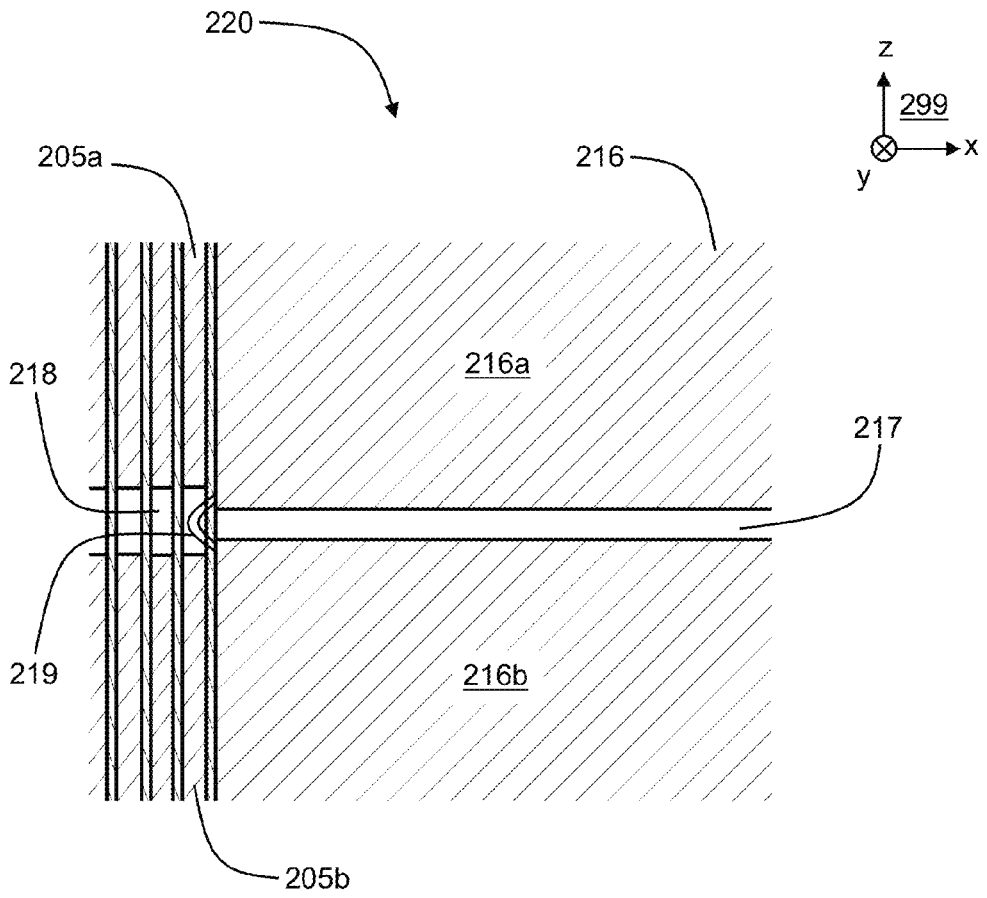
Figure 2C:
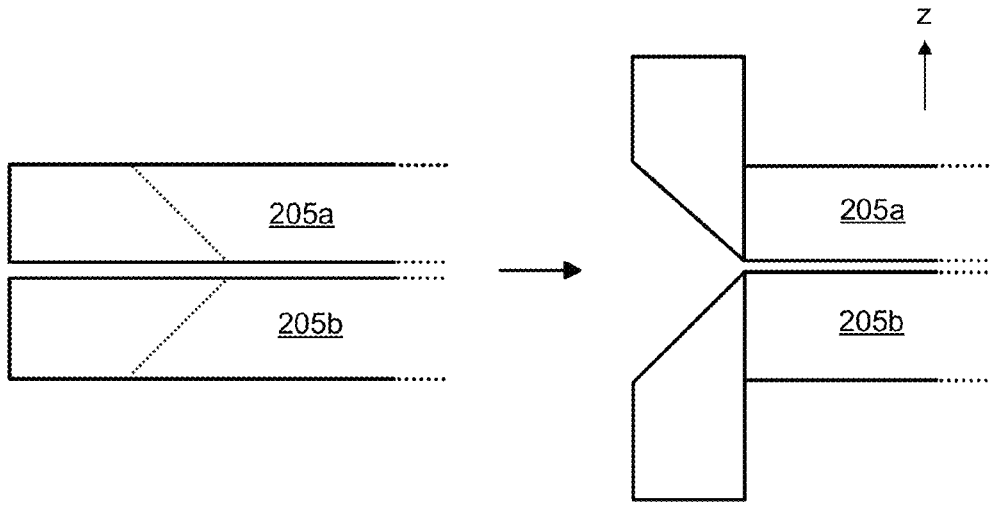

FIG. 2*a* shows a section view of a transformer according to an exemplifying and non-limiting embodiment of the invention. The transformer comprises a first foil winding which can be connected to an external electrical system via connection terminals 209 and 210, and a second foil winding which can be connected to the external electrical system via connection terminals 211 and 212. The first and second foil windings have a substantially same magnetic axis which is parallel with the z-axis of a coordinate system 299. The first foil winding of the transformer is comprised of first winding portions 201 and 202 made of first foil conductors so that the lateral direction of the first foil conductors is parallel with the magnetic axis of the first and second foil windings. The second foil winding of the transformer is comprised of second winding portions 203 and 204 made of second foil conductors so that the lateral direction of the second foil conductors is parallel with the magnetic axis of the first and second foil windings. The winding portions 201-204 are interleaved in the directions perpendicular to the z-axis of the coordinate system 299 so that the winding portion 201 is the innermost one, the winding portion 203 is between the winding portions 201 and 202, the winding portion 204 is the outermost one, and the winding portion 202 is between the winding portions 203 and 204. The transformer comprises a ferromagnetic core structure 213 having a leg 216 surrounded by the first and second foil windings, where the longitudinal direction of the leg is substantially parallel with the magnetic axis of the first and second foil windings, i.e. parallel with the z-axis of the coordinate system 299. The leg comprises two parts 216*a* and 216*b* which are separated from each other in the longitudinal direction of the leg by a non-ferromagnetic gap. FIG. 2*b* shows a magnification of a part 220 of FIG. 2*a*. In FIG. 2*b*, the non-ferromagnetic gap is denoted with a reference number 217. Each foil conductor of the foil windings comprises two mutually parallel strips a distance apart from each other in the direction of the magnetic axis so that a gap 218 between the strips is aligned with the non-ferromagnetic gap 217 so as to hinder the spreading of magnetic flux 219 caused by the non-ferromagnetic gap 217 from inducing eddy currents in the foil conductors closest to the leg 216. In FIGS. 2*a* and 2*b*, the two mutually parallel strips of the foil conductor of the winding portion 201 are denoted with reference numbers 205*a* and 205*b*. FIG. 2*c* illustrates how the strips are folded to two mutually opposite directions so that the ends of the strips can be connected to the ends of the corresponding strips 206*a* and 206*b* of the winding portion 202 as illustrated in FIG. 2*a*.

It is worth noting that the above-described reduction of eddy currents can be achieved also by arranging only a foil conductor portion which is a part of one of the foil conductors and which is closest to the leg 216 to have two mutually parallel strips a distance apart from each other in the direction of the magnetic axis, i.e. the z-axis, so that the gap between these strips is aligned with the non-ferromagnetic gap 217. Thus, all the foil conductors do not need to consist of two mutually parallel strips and even the whole foil conductor which is closest to the leg does not need to consist of two mutually parallel strips. The choice between different alternatives is dependent on e.g. manufacture related viewpoints.

In the exemplifying transformers illustrated in FIGS. 1*a*-1*e* and in FIGS. 2*a*-2*c*, the connection terminals 109-112 and 209-212 are single sided so that they protrude in the positive z-directions of the coordinate systems 199 and 299. The connection terminals can be constructed for example by folding the foil conductors to form a substantially right angle so that the folding line has an angle of 45 degrees with respect to the longitudinal direction of the foil conductor under consideration. It is also possible to have two-sided connection terminals which can be constructed in the way illustrated in FIG. 1*e* or in the way illustrated FIG. 2*c* depending on the case.

Figure 3:
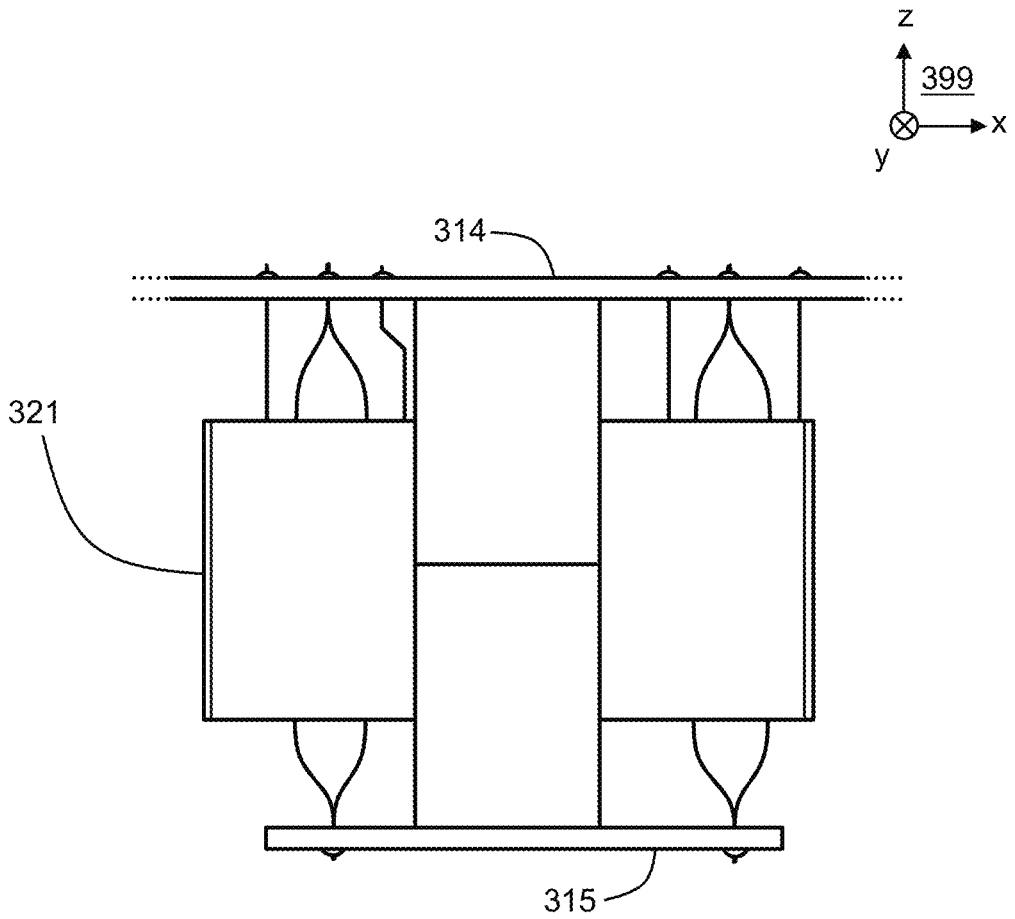
FIG. 3 illustrates a transformer system according to an exemplifying and non-limiting embodiment of the invention.

FIG. 3 illustrates a transformer system according to an exemplifying and non-limiting embodiment of the invention. The transformer system comprises a transformer 321 and first and second circuit boards 314 and 315. The circuit boards are parallel with the xy-plane of a coordinate system 399. The transformer can be for example such as the transformer illustrated in FIGS. 1*a*-1*e* or the transformer illustrated in FIGS. 2*a*-2*c*. In this exemplifying case, each of the connection terminals of the transformer 321 is soldered to an electrical conductor of the circuit board 314. The ends of each pair of the strips folded to the positive z-direction of the coordinate system 399 and constituting one of the connection bridges are soldered to an electrical conductor of the circuit board 314, and the ends of each pair of the strips folded to the negative z-direction of the coordinate system 399 and constituting one of the connection bridges are soldered to an electrical conductor of the circuit board 315. The connection terminals and/or the ends of the strips can be threaded to through-holes of the circuit boards and thereafter soldered to the electrical conductors of the circuit boards. It is also possible that the connection terminals and/or the ends of the strips are soldered or otherwise attached to connections pads on the surfaces of the circuit boards.

The specific, non-limiting examples provided in the description given above should not be construed as limiting the scope and/or the applicability of the appended claims. For example, a transformer according to an exemplifying and non-limiting embodiment of the invention may comprise three of more foil windings having mutually interleaved winding portions.

What is claimed is:

1. A transformer comprising:

two or more first foil conductors constituting first winding portions of a first foil winding, and one or more second foil conductors constituting one or more second winding portions of a second foil winding having a substantially same magnetic axis as the first foil winding, wherein the magnetic axis is substantially parallel with a lateral direction of the first and second foil conductors and the first winding portions are interleaved with the second winding portions in directions substantially perpendicular to the magnetic axis, and wherein the first winding portions are electrically interconnected so that:

at least one end-portion of each of the first foil conductors is split to constitute two strips folded to mutually opposite directions substantially parallel with the magnetic axis, and ends of the strips belonging to one of the first winding portions are connected to ends of the strips belonging to another one of the first winding portions so as to constitute connection bridges over a particular one of the second winding portions located between these ones of the first winding portions.

2. A transformer according to claim 1, wherein number of the second winding portions is at least two and the second winding portions are electrically interconnected so that:

at least one end-portion of each of the second foil conductors is split to constitute two strips folded to mutually opposite directions substantially parallel with the magnetic axis, and ends of the strips belonging to one of the second winding portions are connected to ends of the strips belonging to another one of the second winding portions so as to constitute connection bridges over a particular one of the first winding portions located between these ones of the second winding portions.

3. A transformer according to claim 1, wherein the ends of each pair of the strips folded to a first one of the directions substantially parallel with the magnetic axis and constituting one of the connection bridges are soldered to an electrical conductor of a first circuit board.

4. A transformer according to claim 2, wherein the ends of each pair of the strips folded to a first one of the directions substantially parallel with the magnetic axis and constituting one of the connection bridges are soldered to an electrical conductor of a first circuit board.

5. A transformer according to claim 1, wherein the ends of each pair of the strips folded to a second one of the directions substantially parallel with the magnetic axis and constituting one of the connection bridges are soldered to an electrical conductor of a second circuit board.

6. A transformer according to claim 2, wherein the ends of each pair of the strips folded to a second one of the directions substantially parallel with the magnetic axis and constituting one of the connection bridges are soldered to an electrical conductor of a second circuit board.

7. A transformer according to claim 1, wherein the transformer comprises a core structure having a leg surrounded by the first and second foil windings, a longitudinal direction of the leg being substantially parallel with the magnetic axis.

8. A transformer according to claim 2, wherein the transformer comprises a core structure having a leg surrounded by the first and second foil windings, a longitudinal direction of the leg being substantially parallel with the magnetic axis.

9. A transformer according to claim 7, wherein the core structure comprises ferromagnetic material and the leg comprises two parts separated from each other in the longitudinal direction of the leg by a non-ferromagnetic gap.

10. A transformer according to claim 9, wherein at least a foil conductor portion which is a part of one of the first and second foil conductors and which is closest to the leg comprises two mutually parallel strips a distance apart from each other in the direction of the magnetic axis so that a gap between the strips is aligned with the non-ferromagnetic gap so as to hinder spreading of magnetic flux caused by the non-ferromagnetic gap from inducing eddy currents in the foil conductor portion.

11. A transformer according to claim 9, wherein each of the first and second foil conductors comprises two mutually parallel strips a distance apart from each other in the direction of the magnetic axis so that a gap between the strips is aligned with the non-ferromagnetic gap so as to hinder spreading of magnetic flux caused by the non-ferromagnetic gap from inducing eddy currents in those of the first and second foil conductors closest to the leg.

12. A transformer according to claim 10, wherein each of the first and second foil conductors comprises two mutually parallel strips a distance apart from each other in the direction of the magnetic axis so that a gap between the strips is aligned with the non-ferromagnetic gap so as to hinder spreading of magnetic flux caused by the non-ferromagnetic gap from inducing eddy currents in those of the first and second foil conductors closest to the leg.

13. A transformer according to claim 8, wherein the core structure comprises ferromagnetic material and the leg comprises two parts separated from each other in the longitudinal direction of the leg by a non-ferromagnetic gap.

14. A transformer according to claim 13, wherein at least a foil conductor portion which is a part of one of the first and second foil conductors and which is closest to the leg comprises two mutually parallel strips a distance apart from each other in the direction of the magnetic axis so that a gap between the strips is aligned with the non-ferromagnetic gap so as to hinder spreading of magnetic flux caused by the non-ferromagnetic gap from inducing eddy currents in the foil conductor portion.

15. A transformer according to claim 13, wherein each of the first and second foil conductors comprises two mutually parallel strips a distance apart from each other in the direction of the magnetic axis so that a gap between the strips is aligned with the non-ferromagnetic gap so as to hinder spreading of magnetic flux caused by the non-ferromagnetic gap from inducing eddy currents in those of the first and second foil conductors closest to the leg.

16. A transformer according to claim 14, wherein each of the first and second foil conductors comprises two mutually parallel strips a distance apart from each other in the direction of the magnetic axis so that a gap between the strips is aligned with the non-ferromagnetic gap so as to hinder spreading of magnetic flux caused by the non-ferromagnetic gap from inducing eddy currents in those of the first and second foil conductors closest to the leg.

* * * * *